US008164031B2

(12) United States Patent
Francis et al.

(10) Patent No.: US 8,164,031 B2
(45) Date of Patent: Apr. 24, 2012

(54) ELECTRIC TRACE TUBE BUNDLE WITH INTERNAL BRANCH CIRCUIT

(75) Inventors: Stephen J. Francis, Mogadore, OH (US); Lawrence K. Kunkel, Aurora, OH (US); Dale J. Zelesnik, Strongsville, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 1176 days.

(21) Appl. No.: 11/933,812

(22) Filed: Nov. 1, 2007

(65) Prior Publication Data

US 2008/0210682 A1 Sep. 4, 2008

Related U.S. Application Data

(60) Provisional application No. 60/863,819, filed on Nov. 1, 2006, provisional application No. 60/865,969, filed on Nov. 15, 2006.

(51) Int. Cl.
*H05B 1/02* (2006.01)

(52) U.S. Cl. ..... 219/494; 219/483; 219/505; 219/553

(58) Field of Classification Search ..... 219/495, 219/497, 483, 486, 504, 505, 469–490, 541–553
See application file for complete search history.

(56) References Cited

U.S. PATENT DOCUMENTS 3,764,779 A * 10/1973 Kadoya et al. ..... 219/201
4,285,369 A 8/1981 Misiura et al.
4,395,623 A * 7/1983 Shimada et al. ..... 219/544
5,499,528 A * 3/1996 Bahar ..... 73/23.2
5,897,732 A 4/1999 Schlameus et al.
6,140,587 A 10/2000 Sackett
6,278,085 B1 * 8/2001 Abukasm ..... 219/213
6,564,011 B1 * 5/2003 Janoff et al. ..... 392/480
6,738,566 B2 * 5/2004 Pagnella ..... 392/472
6,762,395 B2 7/2004 Yagnik et al.
6,810,916 B2 11/2004 Thompson
6,901,968 B2 6/2005 Thomson
6,905,566 B1 6/2005 Pitzer et al.
7,322,415 B2 * 1/2008 de St. Remey ..... 166/302
7,802,485 B2 * 9/2010 Wright et al. ..... 73/863.85
7,853,132 B2 * 12/2010 Muller ..... 392/479
2007/0210893 A1 * 9/2007 Hasunuma et al. ..... 338/25

OTHER PUBLICATIONS

Unitherm 2256/2266 Self-Regulating Electric Trace Tubing, 2003, 13 pages.
Dekoron/Unitherm 1548-12000 and 1548-1200J Electrical Connection Kits, 2 pages.

* cited by examiner

*Primary Examiner* — Mark Paschall
(74) *Attorney, Agent, or Firm* — Renner, Otto, Boisselle & Sklar, LLP

(57) ABSTRACT

An electric trace tube bundle characterized by an internal branched circuit or circuits wherein power to the branched circuit or circuits is supplied via leads contained within a tubular jacket surrounding an insulation layer and an inner core containing one or more process tubes and the heater circuits. Such an arrangement allows the power connection to the heater circuits to be made at a proximal end of the bundle, thereby eliminating the need to cut through the jacket to make branched circuit power connections at a location remote from the proximal end of the bundle.

17 Claims, 3 Drawing Sheets

ELECTRIC TRACE TUBE BUNDLE WITH INTERNAL BRANCH CIRCUIT

RELATED APPLICATIONS

This application claims the benefit of U.S. Provisional Application No. 60/863,819 filed Nov. 1, 2006, and U.S. Provisional Application No. 60/865,969 filed Nov. 15, 2006, both of which are hereby incorporated herein by reference.

FIELD OF THE INVENTION

The present invention relates to electric trace tube bundles and more particularly to such tube bundles having a long length.

BACKGROUND OF THE INVENTION

Electric trace tube bundles, also referred to as trace tubing, typically comprises one or more process tubes traced with a heating cable, a heat transfer foil wrap, non-hygroscopic glass fiber insulation, and a PVC jacket. Applications include analyzer, impulse and instrument lines, small diameter process lines, stack gas sampling lines, and utility lines. The heating cable may be of a self-regulating type. Typical applications of such tubing include analyzer lines, process lines, stack gas sampling lines, and utility lines.

More complex electric trace tube bundles are often used as umbilicals for monitoring and probe control in a continuous emission monitoring system. The bundles may include a heated core section and an outer unheated probe support section all contained within an outer jacket. The heated core may include one or more tubes, such as sample, calibration and/or spare tubes. The inner core is heated by a heating cable that preferably provides uniform and consistent heating of the process tube or tube of the inner core. The heating cable can replace the heat that is lost through the thermal insulation system.

The inner core may also include a temperature sensor device, such as a resistance temperature device (RTD) or thermocouple, to allow for uniform heat control under various ambient and process conditions. The inner core usually is surrounded by non-hygroscopic glass fiber insulation. The outer section of the bundle, which is located outside the heated and insulated core section, may include tubes that do not need to be heated, electrical wires and probe temperature sensor wires, such as thermocouple extension cables. The unheated tubes may be used, for example, as air and calibration lines. The tubes can be of various sizes and uniquely identified, such as by color coding. The heated core section and unheated outer section are all contained within a jacket made of, for example, FR-PVC, FR-TFE or urethane materials.

Some continuous emission monitoring systems, such as systems used to monitor gas or particulate matter concentration or emission rate of smokestacks, require long analyzer bundle lengths. FIG. 1 shows a prior art umbilical 10 extending between monitoring equipment 12 and a probe 14 disposed in a process stream 16 at the top of a stack 18. The length of the umbilical 10 may exceed the effective operating length of the heater cable utilized therein, in which case not only must a power source 20 be provided at the monitoring end of the umbilical, but also at one or more locations 22 along the length of the umbilical. That is, a junction box 24 would be provided on the stack 18 at each location 22 for connection of power to the umbilical by means of a branched circuit box 26. In the case of a smokestack, the installer heretofore had to scale the stack to access power leads at one or more intervals along the length of the umbilical, and then cut through the sheath, and connect power leads at connection locations spaced no greater than the effective operating length of a heater cable extending to that location. After the splice was completed, the installer would then enclose the junction within the branched circuit box to protect the connection from the environment. Such installation procedure was time-consuming, difficult, tedious, and prone to error given the adverse conditions under which the connection had to be made.

SUMMARY OF THE INVENTION

The present invention provides an electric trace tube bundle characterized by an internal branched heater circuit or circuits wherein power to the branched heater circuit or circuits is supplied via leads contained within a tubular jacket surrounding an insulation layer and an inner core containing one or more process tubes and the heater circuits. Such an arrangement allows the power connection to the heater circuits to be made at a proximal end of the bundle, thereby eliminating the need to cut through the jacket to make branched circuit power connections at a location remote from the proximal end of the bundle.

Accordingly, the invention provides an electric trace tube bundle comprising a heated core extending longitudinally from a proximal end of the bundle to a distal end of the bundle, a core insulation layer surrounding the heated core along the length thereof, and an outer tubular jacket surrounding the core insulation layer along the length thereof. The heated core includes at least one process tube and plural discrete heaters extending serially along the process tube from the proximal end to the distal end of the bundle for heating the process tube over the length thereof. Respective power leads are provided for the plural heaters, with the power lead for the first heater closest to the proximal end of the bundle being accessible at the proximal end of the bundle, and the power lead of a distal heater remote from the proximal end extending from the respective heater to the proximal end of the bundle within the confines of the tubular jacket.

Each heater may have located at a position along the length thereof, a respective temperature sensor, and each temperature sensor may have sensor leads extending within the confines of the tubular jacket to the proximal end of the bundle.

The temperature sensor may be a resistance temperature device or a thermistor.

The leads for the temperature sensor associated with the distal heater may have a radial portion running radially outwardly from the inner core and a longitudinal portion running longitudinally between the core insulation layer and the tubular jacket. The longitudinal portion of the leads for the distal heater may be helically wound around the inner insulation layer.

The temperature sensors may be located near the proximal ends of the respective heaters.

The heaters preferably extend end-to-end without any longitudinal overlap.

Each heater may be a self-regulating, constant wattage, mineral insulated, series resistance and/or any other electric heater with a fixed circuit length less than the continuous bundle length.

The leads for the distal heater may have a radial portion running radially outwardly from the inner core and a longitudinal portion running longitudinally between the core insulation layer and the tubular jacket. The longitudinal portion of the leads for the distal heater may be helically wound around the inner insulation layer.

The leads for the distal heater may be surrounded by an outer layer of insulation that in turn is surrounded by the tubular jacket.

One or more support tubes may extend along the length of the bundle between the inner and outer insulation layers.

Further features of the invention will become apparent from the following detailed description when considered in conjunction with the drawings.

DETAILED DESCRIPTION

Figure 1:
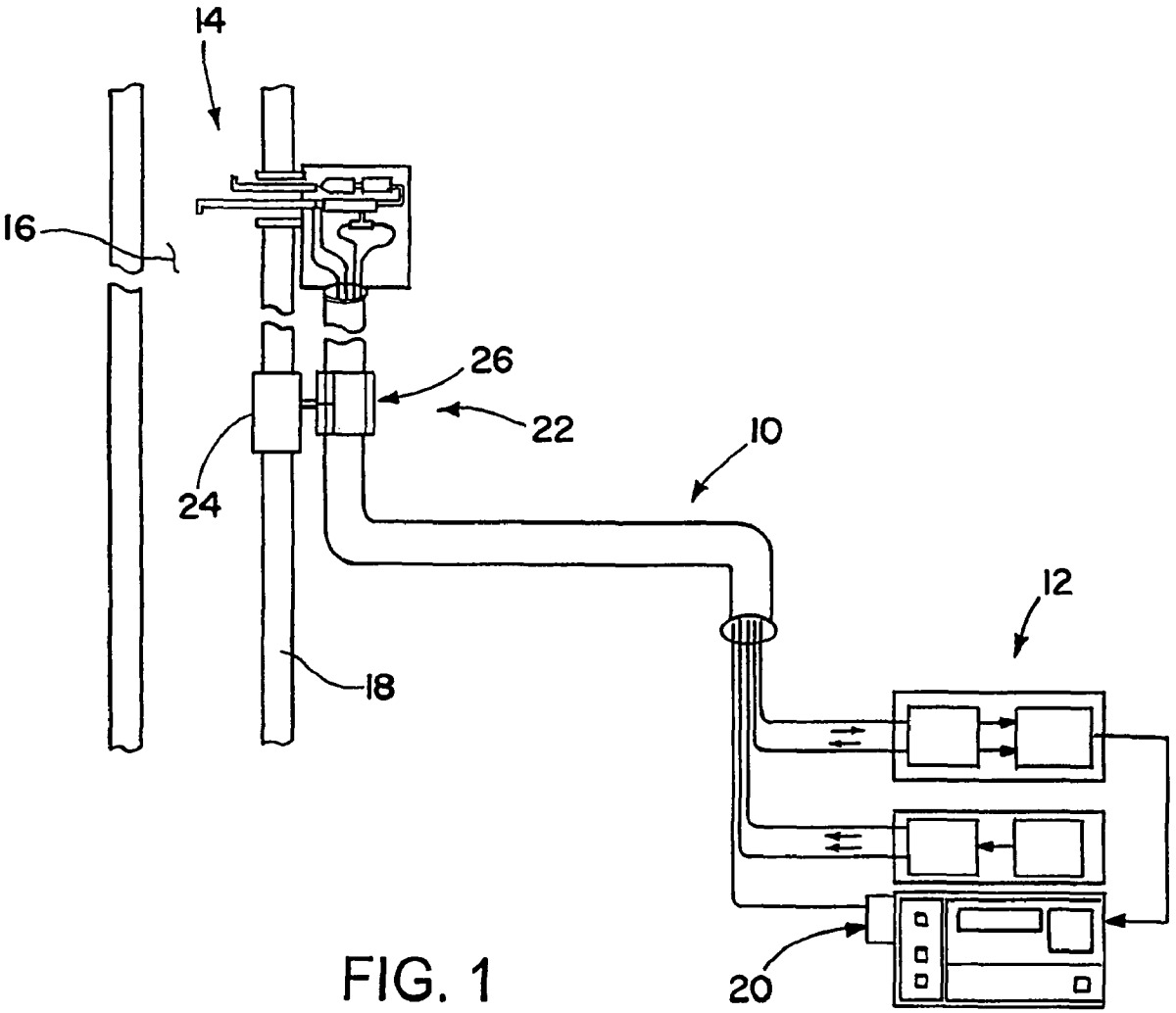
FIG. 1 is a diagrammatic illustration of a prior art installation of a umbilical between monitoring equipment and a probe disposed in a process stream at the top of a stack.
Figure 2:
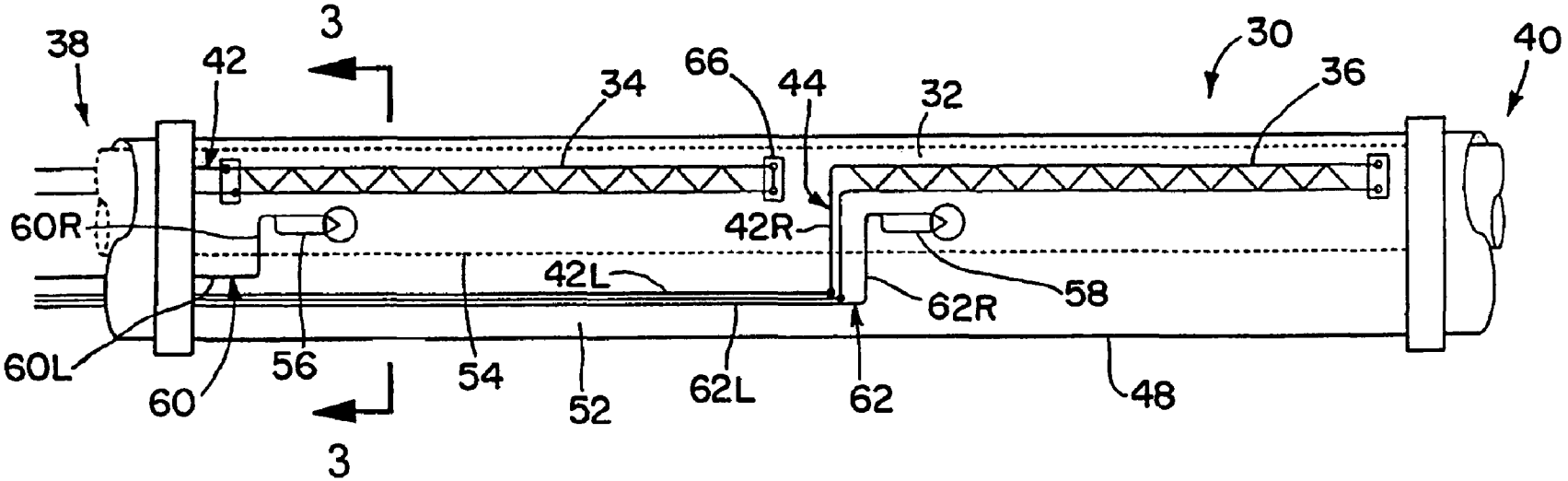
FIG. 2 is a schematic illustration of an electric trace tube bundle according to the present invention.

Referring now to the drawings in detail, FIG. 2 shows a schematic of a trace tube bundle according to the present invention, which bundle is designated generally by reference numeral 30. The bundle 30 comprises a core section 32 that is heated by plural discrete heaters 34 and 36 extending serially along the core section from a proximal end 38 to a distal end 40 of the bundle 30. Respective power leads 42 and 44 are provided for the heaters 34 and 36. The power leads 42 for the first heater 34 closest to the proximal end 38 of the bundle are accessible at the proximal end of the bundle. The power leads 42 for the distal heater 36 remote from the proximal end 38 extend from the respective heater 36 to the proximal end of the bundle within the confines of a tubular jacket 48.

The leads 44 for the distal heater 36 may have a radial portion 42R running radially outwardly from the inner core 32 and a longitudinal portion 42L running longitudinally from the radial portion 42R to the proximal end 38 in an outer section 52 of the bundle located between a core insulation layer 55 surrounding the inner core 32 and the tubular jacket 48.

The heaters 34 and 36 may have located at a position along the length thereof, respective temperature sensors 56 and 58 located within the heated core section 32. The temperature sensors 56 and 58 have respective leads 60 and 62 extending within the confines of the tubular jacket 48 to the proximal end of the bundle. The temperature sensors may be resistance temperature devices or thermistors, and such sensors may be used in a conventional manner to allow for uniform heat control under various ambient and process conditions. The temperature sensors may be located near the proximal ends of the respective heaters.

Like the heater leads, the leads 60 and 62 for the temperature sensors each may have a radial portion 60R, 62R running radially outwardly from the inner core and a longitudinal portion 60L and 62L running longitudinally between the core insulation layer 50 and the tubular jacket 48 from the radial portions to the proximal end 38 of the bundle.

Although not shown, the bundle may be provided with additional branch heater circuits as needed for a given application, with the power and sensor leads associated therewith running from the branch heater circuits and associated temperature sensor to the proximal end of the bundle within the confines of the outer tubular jacket 48. As will be appreciated, all internal connections will be made before the outer tubular jacket is applied to enclose and preferably hermetically seal the interior electrical components of the cable. Such an arrangement allows external power connections to the heater circuits to be made at the proximal end 38 of the bundle, thereby eliminating the need to cut through the jacket to make branched circuit power and/or sensor connections at a location remote from the proximal end of the bundle.

As shown in FIG. 2, the heaters 34 and 36, also referred to as heater circuits or segments, preferably extend end-to-end along the bundle without any longitudinal overlap. That is, the proximal heater 34 is terminated at a termination 66 located closer to the proximal end of the bundle than the proximal end of the distal heater 36, as illustrated in FIG. 2. Each heater may be a self-regulating, constant wattage, mineral insulated, series resistance and/or any other electric heater with a fixed circuit length less than the continuous bundle length.

Figure 3:
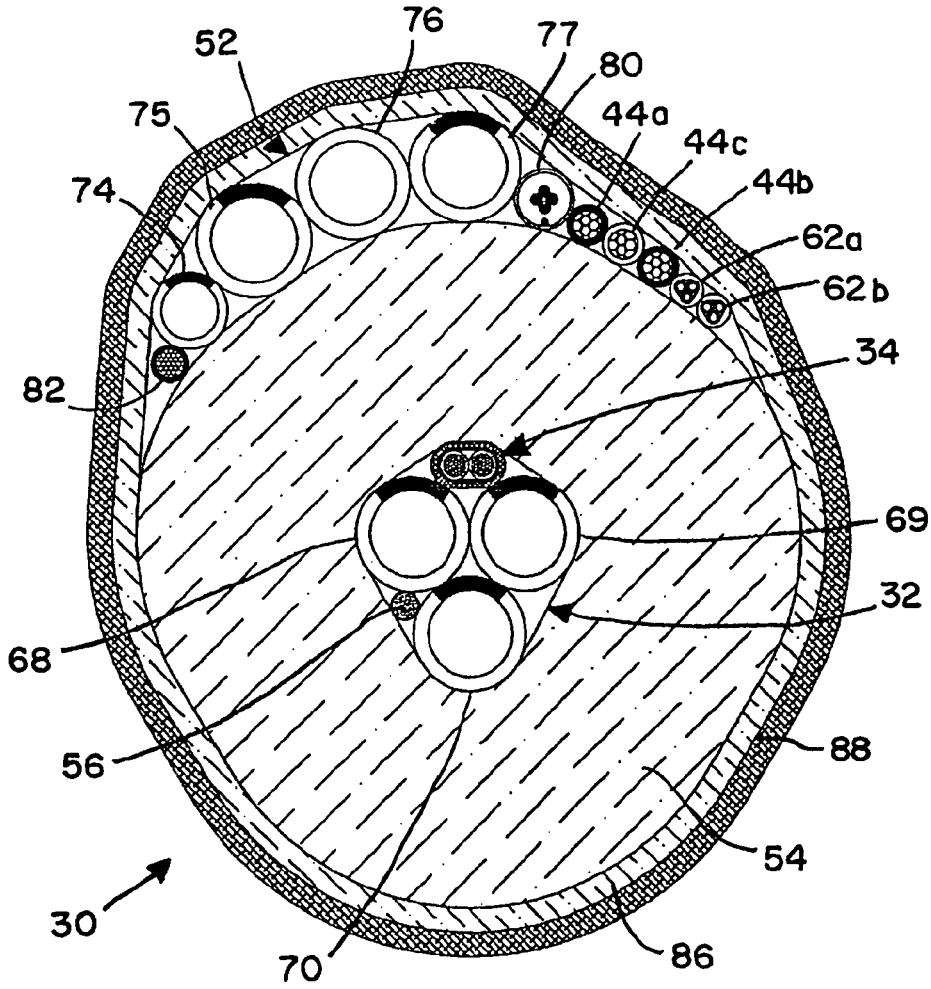
FIG. 3 is a cross-sectional view through an exemplary electric trace tube bundle according to the invention.

Referring now to FIG. 3, the bundle 30 is shown in cross-section. As shown, the heated core section 32 further comprises one or more process tubes 68-70 that may be, for example, parallel to the bundle axis or helically wound. In a continuous emission monitoring system, the process tubes 68-70 may be sample, calibration and/or spare tubes. The tubes can be of various sizes and uniquely identified, such as by color coding.

In FIG. 3, only the heater 34 is shown, the cross-section being taken at the location of the temperature sensor 56. As shown, the heater 34 is in the form of a heater cable that may be spirally wrapped around the process tubes 68-70. The heater includes a pair of insulated wires enclosed within a heater jacket that is surrounded by a braided ground conductor. The heating cable preferably provides uniform and consistent heating of the process tube or tubes of the inner core.

The temperature sensor 56 may be located in an interstitial space between the process tubes and the surrounding insulation layer 50 preferably at a location remote from the heater cable. The insulation layer 50 may be formed from any suitable insulation, such as non-hygroscopic fiberglass thermal insulation.

The outer section 50 of the bundle, which is located between the core insulation layer 50 and the tubular jacket 48, may include one or more support tubes 74-77 that do not need to be heated. In a continuous emission monitoring system, the unheated tubes may be used, for example, as air and calibration lines. The tubes can be of various sizes and uniquely identified, such as by color coding.

The heated core section 50 also includes the heater power leads 44 from the distal heater cable 36 (FIG. 2). The power leads 44 may include a positive insulated conductor 44*a*, a negative insulated conductor lead 44*b*, and an insulated ground conductor that is connected to the braid of the heater cable 36. As described above, the power leads for the distal heater 36 may be taken out radially from the heated core section through the core insulation layer, and then run longitudinally between the core insulation and the tubular jacket 48. The conductors 44*a*, 44*b* and 44*c* may be helically wrapped around the core insulation layer, as may the support tubes 74-77 and other wires in the outer section that run along the length of the bundle.

In addition to the power leads 44, the outer section further includes the sensor leads 62 for the temperature sensor associated with the distal heater cable 36. The sensor leads 62 include a pair of insulated conductors 62*a* and 62*b*. The outer section may further include other electrical conductors, such as a dual twisted pair cable 80 that, for example, may provide for connection to a probe at the distal end of the bundle, and a further conductor 82. The outer section, or even the core, may include other tube, cables, wires, etc, such as electrical functional wiring and/or fiberoptic cables for additional sensors in processing applications, or for other functions.

As above mentioned, the heated core section and unheated outer section are all contained within the outer jacket 48 which may be made of, for example, FR-PVC, FR-TFE or urethane materials, silicone, natural and synthetic rubber, co-polyester and multi-layer functional engineering polymers (e.g. PEEK, PFA, Pebox, PVDF, HBR, FKM, etc.). The jacket may be formed by a continuous extrusion process, whereby the jacket runs continuously from one end of the bundle to the other end. If the bundle is made in a single process line, extrusion of the jacket will be stopped to effect the electrical connections to the distal heater and temperature sensor, after which extrusion of the jacket is restarted to draw the jacket around the internal connections and complete the formation of the jacket extending continuously from one end of the bundle to the other end. Before the jacket is applied, an outer layer of insulation 86 may be helically wrapped around the core insulation, support tubes and leads, and in turn a moisture barrier 88 may be wrapped around the outer insulation layer. The ends of the jacket may be hermetically sealed to improve functional life expectancy of the bundle. The jacket may also be provided with external markings indicating the location of the heaters, heater connections, temperature sensors, etc., which for example may facilitate safe handling and anchoring of the bundle to a structure. For instance, the locations of the heater connections may be marked so that the bundle can be anchored at a location remote therefrom, so as not to subject the heater connections to high stress, loads, bending forces, etc.

The above-mentioned process and support tubes may be formed of any suitable material for a given application, such as plastic or metal, in particular thermoplastic tubing, copper, stainless steel or other exotic alloys. By way of further example, the tubes can be thermoplastic, metallic or made of thermoset polymers such as rubber, polyethylene and PTFE. Additionally, the insulations may include foamed polymers of thermoplastic or thermoset form, and/or wrapped ceramics and aerogel compounds, by way of example.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

The invention claimed is:

1. An electric trace tube bundle comprising a heated core extending longitudinally from a proximal end of the bundle to a distal end of the bundle, a core insulation layer surrounding the heated core along the length thereof, and an outer tubular jacket surrounding the core insulation layer along the length thereof, wherein the heated core includes at least one process tube and plural discrete heaters extending serially along the process tube from the proximal end to the distal end of the bundle for heating the process tube over the length thereof, wherein respective power leads are provided for the plural heaters, wherein the power lead for the first heater closest to the proximal end of the bundle is accessible at the proximal end of the bundle, and wherein the power lead of a distal heater remote from the proximal end extends from the respective heater to the proximal end of the bundle within the confines of the tubular jacket.

2. An electric trace tube bundle according to claim 1, wherein each heater has located at a position along the length thereof, a respective temperature sensor, and each temperature sensor has sensor leads extending within the confines of the tubular jacket to the proximal end of the bundle.

3. An electric trace tube bundle according to claim 2, wherein the temperature sensor is a resistance temperature device or a thermistor.

4. An electric trace tube bundle according to claim 2, wherein the leads for the temperature sensor associated with the distal heater have a radial portion running radially outwardly from the inner core and a longitudinal portion running longitudinally between the core insulation layer and the tubular jacket.

5. An electric trace tube bundle according to claim 4, wherein the longitudinal portion of the leads for the distal heater is helically wound around the core insulation layer.

6. An electric trace tube bundle according to claim 2, wherein the temperature sensors are located near the proximal ends of the respective heaters.

7. An electric trace tube bundle according to claim 1, wherein the heaters extend end-to-end without any longitudinal overlap.

8. An electric trace tube bundle according to claim 1, wherein each heater is a self-regulating heater cable, constant wattage heater cable, or a series resistance heater cable with a fixed circuit length less than the continuous bundle length.

9. An electric trace tube bundle according to claim 1, wherein the leads for the distal heater have a radial portion running radially outwardly from the inner core and a longitudinal portion running longitudinally between the core insulation layer and the tubular jacket.

10. An electric trace tube bundle according to claim 1, wherein the longitudinal portion of the leads for the distal heater is helically wound around the core insulation layer.

11. An electric trace tube bundle according to claim 1, wherein the leads for the distal heater are surrounded by an outer layer of insulation that in turn is surrounded by the tubular jacket.

12. An electric trace tube bundle according to claim 1, wherein one or more support tubes extend along the length of the bundle between the core and outer insulation layers.

13. An electric trace tube bundle according to claim 2, wherein the temperature sensors are located near the proximal ends of the respective heaters.

14. An electric trace tube bundle according to claim 13, wherein the heaters extend end-to-end without any longitudinal overlap.

15. An electric trace tube bundle according to claim 14, wherein the leads for the distal heater have a radial portion running radially outwardly from the inner core and a longitudinal portion running longitudinally between the core insulation layer and the tubular jacket.

16. An electric trace tube bundle according to claim 15, wherein the leads for the distal heater are surrounded by an outer layer of insulation that in turn is surrounded by the tubular jacket.

17. An electric trace tube bundle according to claim 16, wherein one or more support tubes extend along the length of the bundle between the core and outer insulation layers.

* * * * *